US005870954A

United States Patent [19]

Lovenstein et al.

[11] Patent Number: 5,870,954

[45] Date of Patent: Feb. 16, 1999

[54] RETRACTABLE CLEANING SYSTEM FOR LITHOGRAPHIC PRINTING PLATES

[75] Inventors: James V. Lovenstein, Hudson, N.H.; James R. Moss, Altamonte Springs, Fla.

[73] Assignee: Presstek, Inc., Hudson, N.H.

[21] Appl. No.: 10,858

[22] Filed: Jan. 22, 1998

[51] Int. Cl.[6] ..... B41F 35/00

[52] U.S. Cl. ..... 101/423; 101/425

[58] Field of Search ..... 101/423, 425, 101/424; 15/256.5, 256.51, 256.52

[56] References Cited

U.S. PATENT DOCUMENTS

| | | | |
|---|---|---|---|
| 2,711,563 | 6/1955 | Lathauwer | 15/256.51 |
| 3,389,656 | 6/1968 | Giori | 101/424 |
| 3,737,940 | 6/1973 | Moestue et al. | 15/302 |
| 3,763,778 | 10/1973 | Sills et al. | 101/426 |
| 3,822,642 | 7/1974 | Grindeland | 101/425 |
| 3,871,081 | 3/1975 | Inoue et al. | 15/256.51 |
| 3,976,007 | 8/1976 | Junghans | 101/425 |
| 3,983,813 | 10/1976 | Tani | 101/425 |
| 4,015,307 | 4/1977 | Kossak | 15/256.52 |
| 4,088,215 | 5/1978 | Bader | 400/56 |
| 4,095,240 | 6/1978 | Tsutsui | 346/163 |
| 4,265,705 | 5/1981 | Pyykkonen | 162/272 |
| 4,449,241 | 5/1984 | Nakayama | 15/256.52 |
| 4,499,827 | 2/1985 | Takeuchi et al. | 101/425 |
| 4,667,597 | 5/1987 | Wright et al. | 101/425 |
| 4,704,963 | 11/1987 | Nishimura et al. | 101/425 |
| 4,775,869 | 10/1988 | Minowa | 346/76 PH |
| 4,826,539 | 5/1989 | Harpold | 134/10 |
| 4,841,862 | 6/1989 | Seefried | 101/423 |
| 4,872,416 | 10/1989 | Daniel et al. | 118/203 |
| 4,875,412 | 10/1989 | Wright et al. | 101/425 |
| 4,905,596 | 3/1990 | Kobler | 101/216 |
| 4,972,780 | 11/1990 | Gasparrini et al. | 101/217 |
| 4,986,182 | 1/1991 | Sawaguchi et al. | 101/483 |
| 5,010,819 | 4/1991 | Uribe et al. | 101/425 |
| 5,117,754 | 6/1992 | Nozaka et al. | 101/425 |
| 5,148,746 | 9/1992 | Fuller et al. | 101/142 |
| 5,152,220 | 10/1992 | Lindner et al. | 101/155 |
| 5,213,040 | 5/1993 | Mihori et al. | 101/424 |
| 5,224,424 | 7/1993 | Layland | 101/423 |
| 5,245,925 | 9/1993 | Switall et al. | 101/425 |
| 5,251,348 | 10/1993 | Corrado et al. | 15/256.53 |
| 5,265,537 | 11/1993 | Gasparrini et al. | 101/425 |
| 5,271,326 | 12/1993 | Ebina | 101/425 |
| 5,275,104 | 1/1994 | Corrado et al. | 101/425 |
| 5,303,652 | 4/1994 | Gasparrini et al. | 101/425 |
| 5,322,015 | 6/1994 | Gasparrini | 101/425 |
| 5,325,779 | 7/1994 | Ebina | 101/423 |
| 5,367,955 | 11/1994 | Hara et al. | 101/424 |
| 5,404,819 | 4/1995 | Hishinuma et al. | 101/425 |
| 5,408,930 | 4/1995 | Loos | 101/423 |
| 5,425,309 | 6/1995 | Saito et al. | 101/423 |
| 5,450,792 | 9/1995 | Gegenheimer et al. | 101/425 |
| 5,566,617 | 10/1996 | Durrnagel | 101/483 |
| 5,611,281 | 3/1997 | Corrado et al. | 101/425 |

FOREIGN PATENT DOCUMENTS

| | | |
|---|---|---|
| 58-200751 | 5/1985 | Japan . |
| 59-248965 | 6/1986 | Japan . |

OTHER PUBLICATIONS

Hull, "Photoreceptor Cleaning", Xerox Disclosure Journal, vol. 3, No. 5, Sep. 10, 1978.

*Primary Examiner*—Ren Yan
*Assistant Examiner*—Anthony H. Nguyen
*Attorney, Agent, or Firm*—Cesari and McKenna, LLP

[57] ABSTRACT

A cleaning apparatus designed for use in conjunction with a lithographic printing member associated with a rotary cylinder comprises an elastomeric (preferably foam) roller for making rotating contact with the printing member; a fixed screen; and a brush in rotating contact with the roller and with the screen. The roller may extend axially at least across the imaging region of the printing member (i.e., that portion of the imaging member that actually receives the image to be printed). The elastomeric roller removes imaging debris from the cylinder, while the brush removes from the roller debris that would otherwise accumulate therein. As the brush rotates past the screen, it sheds debris withdrawn from the roller; debris passing through the screen may be collected, for example, in a container or removed from the system by vacuum. The system may also include one or more doctor blades in contact with the roller for removing debris remaining on the roller following its contact with the brush.

15 Claims, 3 Drawing Sheets

RETRACTABLE CLEANING SYSTEM FOR LITHOGRAPHIC PRINTING PLATES

BACKGROUND OF THE INVENTION

1. Field of the Invention

The present invention relates to digital printing apparatus and methods, and more particularly to a system for cleaning lithographic printing members following digital imaging.

2. Description of the Related Art

In offset lithography, a printable image is present on a printing member as a pattern of ink-accepting (oleophilic) and ink-rejecting (oleophobic) surface areas. Once applied to these areas, ink can be efficiently transferred to a recording is medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The ink-adhesive fountain solution prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers. For example, U.S. Pat. Nos. 5,351,617 and 5,385,092 disclose an ablative recording system that uses low-power laser discharges to remove, in an imagewise pattern, one or more layers of a lithographic printing blank, thereby creating a ready-to-ink printing member without the need for photographic development. In accordance with those systems, laser output is guided from the diode to the printing surface and focused onto that surface (or, desirably, onto the layer most susceptible to laser ablation, which will generally lie beneath the surface layer).

Many kinds of plates imageable by laser or other recording instrument, and particularly those involving ablation mechanisms, generate debris. For example, some of the plates described in U.S. Pat. Nos. 5,339,737 and 5,379,698 include a topmost silicone layer, an underlying layer ablatable by laser discharge, and a strong, stable substrate beneath the ablation layer. Exposure of the plate to a laser pulse destroys the ablation layer, weakening the overlying silicone layer and de-anchoring it. The silicone layer is not, however, removed by imaging. Accordingly, after the plate has been fully scanned by the laser, the disrupted silicone must be removed.

Various approaches have been suggested for removing plate debris produced in the course of platemaking, and specifically in connection with imaging processing involving ablation. One such cleaning system is disclosed in U.S. Pat. No. 5,148,746. Basically, that system comprises a rotating brush affixed to the writing head that can be moved into contact with the surface of the lithographic plate undergoing imaging. While that prior plate-cleaning apparatus operates satisfactorily in many respects, it is relatively slow because the brush cleans only a relatively small area of the plate at any given time. In other words, the brush head must be gradually moved along the entire length of the plate cylinder as it rotates in order to clean the entire surface of the plate. Other cleaning systems for digitally imaged lithographic printing plates are disclosed in U.S. Pat. No. 5,568,768 and copending application Ser. No. 08/756,267.

Particularly in on-press implementations, the cleaning system should be capable of unobtrusive integration within the imaging environment, in terms of both function and structure. That is, operation of the cleaning system should not interfere with the imaging process, and the components of the cleaning system may desirably be mechanically separate from the imaging components. This arrangement would permit the cleaning system to be separately serviced, and also help to avoid unwanted mechanical interactions between imaging and cleaning elements. Indeed, in an on-press configuration, it is generally useful to isolate the cleaning system from ink-transfer components as well.

DESCRIPTION OF THE INVENTION

Brief Summary of the Invention

The present invention provides a conveniently located, selectably actuable plate-cleaning system for on-press and off-press use. The cleaning system of the present invention is mechanically separate from the imaging system, and may be retracted when not in active use. In a preferred embodiment, the system is disposed on a tilt-out panel, facilitating its removal or servicing without contact with (or even proximity to) the components of the imaging system.

The cleaning apparatus of the present invention is designed for use in conjunction with a lithographic printing member associated with a rotary cylinder. The apparatus itself generally comprises an elastomeric (preferably foam) roller for making rotating contact with the printing member; a fixed screen; and a brush in rotating contact with the roller and with the screen. Preferably, the roller extends axially at least across the imaging region of the printing member (i.e., that portion of the imaging member that actually receives the image to be printed).

The elastomeric roller removes imaging debris from the cylinder, while the brush removes from the roller debris that would otherwise accumulate therein. As the brush rotates past the screen, it sheds debris withdrawn from the roller; debris passing through the screen may be collected, for example, in a container or removed from the system by vacuum. The system may also include one or more doctor blades in contact with the roller for removing debris remaining on the roller following its contact with the brush.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
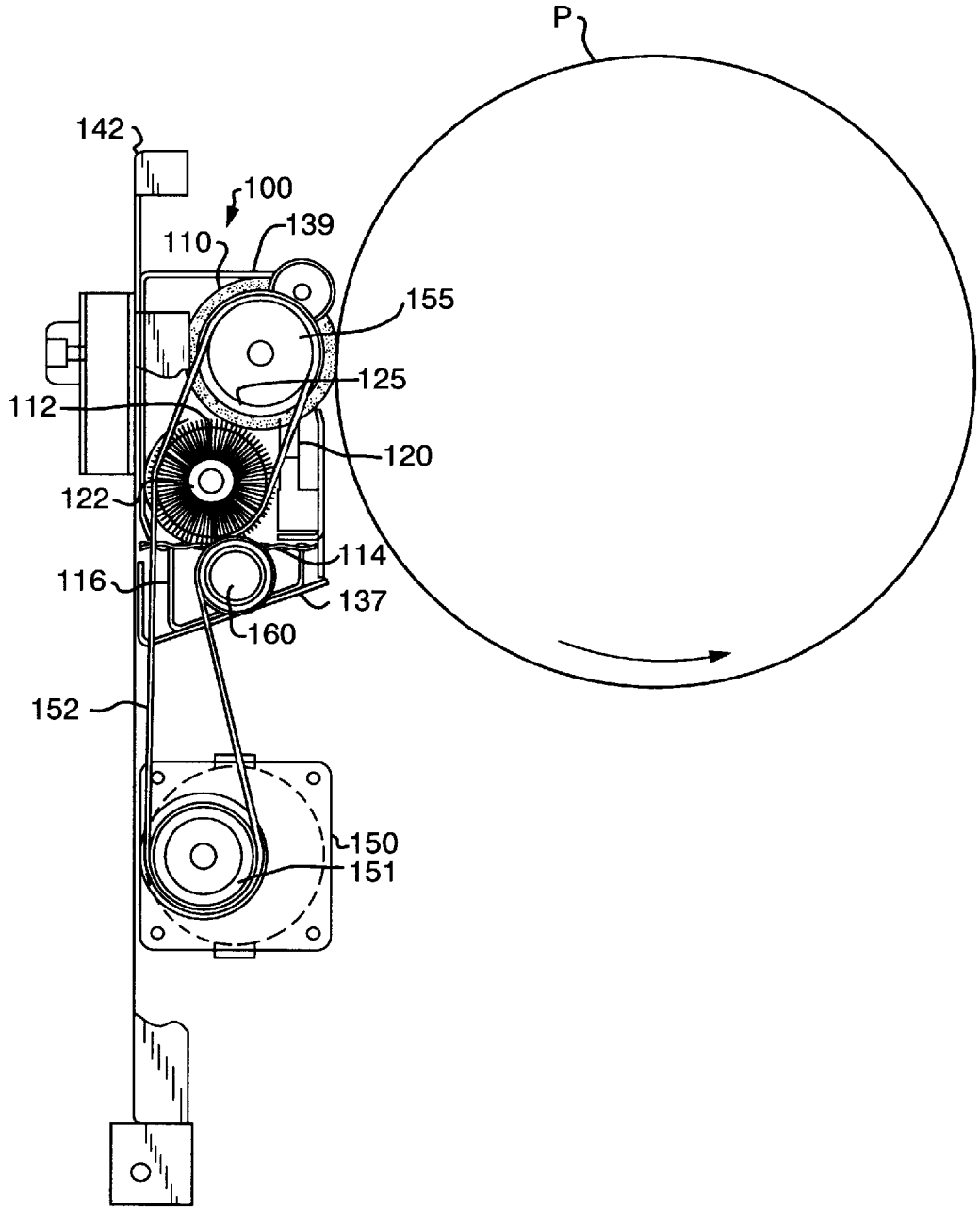
FIG. 1 is a side elevation showing the invention and its relationship in situ to a cylindrical plate-bearing member.

Refer first to FIG. 1, which shows the basic elements of a plate-cleaning apparatus in accordance with the present invention. The cleaning system, indicated generally at 100, includes an elongated, generally cylindrical elastomeric roller 110; an elongated, generally cylindrical brush 112; and a screen 114. Running below screen 114 is a debris basin 116. An optional pair of doctor blades, collectively indicated at 120, also make contact with roller 110.

Roller 110 preferably has a foam surface 110*s*, which surrounds a rigid shaft or mandrel 125. The foam used for surface 110*s* is generally an open-celled elastomer, such as polyurethane (e.g., 5.7 lb/ft$^3$ polyurethane foam). Such a surface is spongy and somewhat soft, enabling it to collapse slightly against a printing member mounted on (or integral with) a plate cylinder P, and is also desirably somewhat tacky; this property assists in drawing off the gummy debris generated by the imaging process on, for example, a silicone-surfaced printing plate. Roller 110 extends axially at least across the imaging region of a printing member on cylinder P, and the longitudinal extents of brush 112 and screen 114 are at least equal to that of roller 110.

Plate cylinder P is typically carried within a print station of a printing press (which will typically have multiple such stations) or within standalone platemaker or "platesetter." An imaging system, not shown, impresses an image onto a plate mounted on plate cylinder P in accordance with stored digital data (see, e.g., the '698 or '737 patents). In an on-press environment, the mounted plate receives ink from an ink-transfer system (not shown) and is in rolling contact, by means of cylinder P, with a blanket cylinder B (see FIG. 2). It is this latter cylinder that actually transfers the ink to a recording medium. As used herein, the term "plate" or "member" refers to any type of printing member or surface capable of recording an image defined by regions exhibiting differential affinities for ink and/or fountain solution; suitable configurations include the traditional planar or curved lithographic plates that are mounted on plate cylinder P of a printing press, but can also include seamless cylinders (e.g., the roll surface of a plate cylinder), an endless belt, or other arrangement.

Figure 3:
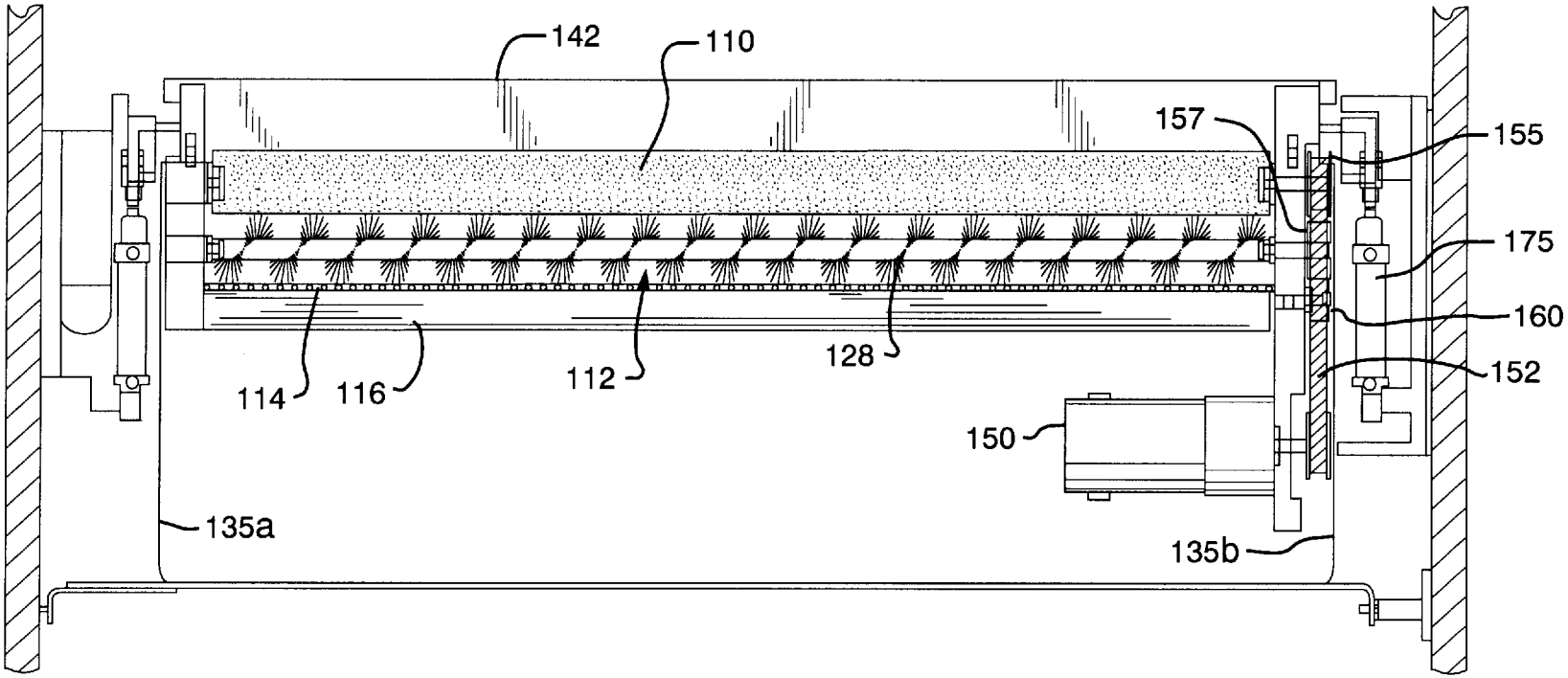
FIG. 3 is a front elevation showing the primary cleaning components.

Thus, roller 110 has a sufficient longitudinal extent to cover the entire imaging region of a printing plate borne on cylinder P (see FIG. 3). Brush 112 is at least as long as roller 110, and may be covered with upstanding bristles (as suggested in FIG. 1) that surround a central shaft or mandrel 122. The bristles are sufficiently stiff to penetrate the pores of an open-celled foam, but not so rigid as to damage the foam during use; for example, the bristles may be made of nylon (in a representative embodiment, the brush is a 0.13 mm nylon fill). Furthermore, it is not necessary for the bristles to occupy the entire surface of brush 112. Instead, as shown in FIG. 3, the bristles may be arranged in a spiral pattern 128.

Figure 2:
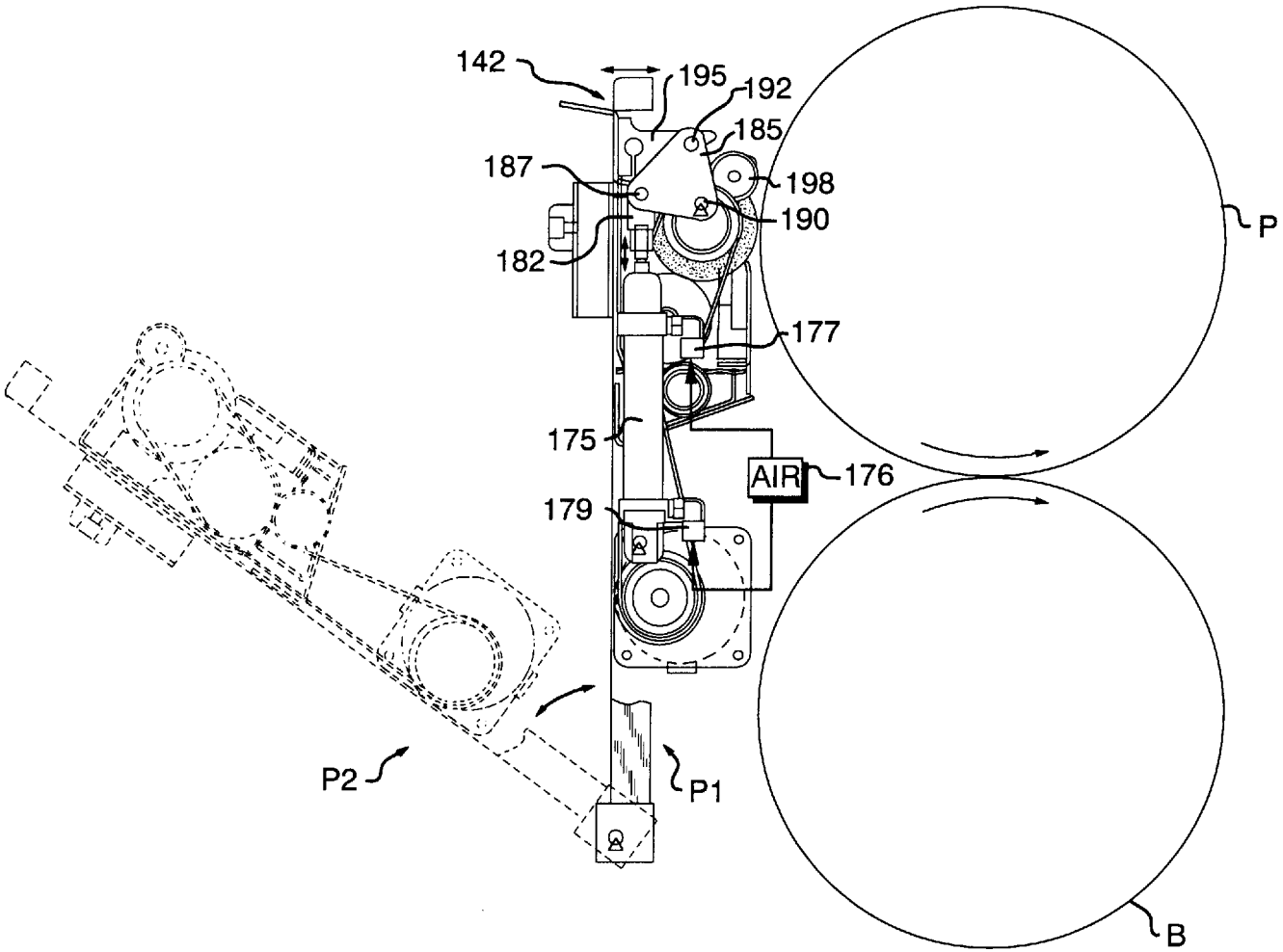
FIG. 2 is another side view of the invention wtih some parts omitted and other parts added, and also illustrating the manner in which the cleaning system may be affixed to a tilt-out pannel.

As shown in FIGS. 1 and 3, the roller 110, brush 112, screen 114 and basin 116 are partially confined within a housing 133 formed by a pair of side walls 135*a*, 135*b* (omitted from FIGS. 1 and 2 for clarity), a floor member 137 (see FIGS. 1 and 2) and a ceiling member 139. The housing 133 is affixed to the interior surface of a hinged panel 142, which tilts, as shown in FIG. 2, from an operative upright position $P_1$ (flush with the remainder of the press or platemaker cabinet, not shown) to an outwardly hanging position $P_2$ that affords access to the components of the invention. In particular, as shown in FIG. 2, the position $P_2$ draws the elements of the invention away from the press. Accordingly, the elements of the invention may be serviced or fully withdrawn without disturbing the interior components of the press (i.e., cylinders P and B). The invention may be configured such that, with panel 142 in position $P_2$, no power is available to motor 150.

With reference to FIG. 1, rotative power is provided by a conventional electric motor 150, and is transferred to the various rotating elements by a drive gear 151 that turns a belt 152. Belt 152 may have a toothed inner surface so as to engage gears associated with motor 150, roller 110 and brush 112. As shown in FIG. 3, the mandrels of roller 110 and brush 112 may be journaled into side walls 135*a*, 135*b*, with drive shafts projecting through side wall 135*a* and terminating in respective drive gears 155, 157. A tensioning roller 160 draws belt 152 against brush drive gear 157 notwithstanding the angular displacement of roller 110 (and, consequently, drive gear 155) with respect to drive gears 151 and 157. Consequently, roller 110 and brush 112 both rotate in the same direction (namely, the rotational direction of motor 150), and at the same rate.

Roller 110 is brought into contact with a plate on cylinder P only after imaging has taken place. Following cleaning, roller 110 is retracted. The mechanism of extension and retraction is illustrated in FIG. 2. A pair of pneumatic pistons, one of which is shown at 175, are affixed to the machine frame or cabinet of the press (or platemaker) on opposite sides of the housing 133. Thus, although the pistons seat just inside panel 142 with the panel in position $P_1$, they are mechanically separate from (and therefore do not tilt with) panel 142. Each piston 175 receives air, supplied by an air source 176 via appropriate tubing (not shown), through a pair of inlets 177, 179. In response to the entry or discharge of air into the piston, the head 182 moves vertically as indicated by the arrow. With specific reference to the illustrated piston 175, the head 182 is pivotally connected to a fixture 185 by means of a wrist pin 187. Fixture 185 is also pivotally connected to a fixed interior surface of the machine frame or cabinet by a hinge pin 190. A fixed pin 192 of fixture 185, which projects inwardly (i.e., toward side wall 135*a*) is carried within a recess of a yoke 195, which is itself fixedly mounted to panel 142. A similar arrangement is carried on the opposite side of housing 133.

Accordingly, piston 175 and fixture 185 form a bell crank. As piston head 182 rises, fixture 185 pivots with respect to the machine frame or cabinet, drawing yoke 195 and, therefore, the entire panel 142 forward—i.e., toward cylinder P. (The pneumatic cylinders are mounted in a manner that accommodates some slight inward movement.) As a result, roller 110 is brought into contact with cylinder P. The extension of the pistons (and, therefore, the allowed horizontal displacement of panel 142) is arrested by a pair of oppositely disposed contact rollers, one of which is indicated at 198, that are fixedly mounted to side walls 135*a*, 135*b* (FIG. 3) and engage a marginal area of cylinder P—outside the imaging region, and if possible, beyond the axial extent of the printing member—in rolling contact. That is, when the contact rollers reach cylinder P, no further horizontal movement is possible. As a result, the proximity of the contact rollers to cylinder P determines the contact pressure of roller 110 against cylinder P when the pistons reach their allowed extension. Preferably, the horizontal position of contact roller 198 and its unillustrated counterpart are adjustable so that the contact pressure may be varied.

In operation, then, the plate on cylinder P is fully imaged, following which motor 150 is activated to cause rotation of roller 110 and brush 112 to a cleaning speed of, e.g., 150 RPM. When the cleaning speed is attained, a signal is sent to air source 176 to inject air into the pistons 175, driving panel 142 and the associated cleaning elements inward from the "standby" position. The spinning roller 110 is thereby brought into contact with a printing member on cylinder P, which continues to rotate in the same direction as roller 110. Roller 110 wipes against the printing member, breaking up material such as silicone over imaged areas of the plate and carrying it off. The rotating roller then encounters brush 112, which draws off a substantial portion of the debris. Finally, before once again encountering the printing member on cylinder P, roller 110 rotates past doctor blades 120, which remove additional debris.

Roller 110 stays in contact with the printing member through several revolutions. The pistons are then retracted, bringing the panel and cleaning components back into the standby position. Roller 110 and brush 112 continue to rotate, however, in order to remove accumulated debris from roller 110 and brush 112. The various actuation signals to accomplish these actions may be provided by circuitry associated with the press or platemaker, or by a dedicated, conventional equipment controller (not shown).

It will therefore be seen that we have developed a convenient and efficient approach to cleaning of lithographic printing plates, particularly those that have been imaged by an ablation process. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Cleaning apparatus for cleaning a printing member associated with a rotary cylinder, the apparatus comprising:

a. a roller for making rotating contact with the printing member, the roller having an elastomeric surface;

b. a fixed screen; and c. a brush in rotating contact with the roller and with the screen, the brush removing debris from the roller and shedding it through the screen.

2. The apparatus of claim 1 further comprising means for retractably bringing the roller into contact with the printing member.

3. The apparatus of claim 1 wherein the elastomeric surface is an open-celled foam.

4. The apparatus of claim 1 wherein the foam is a polyurethane.

5. The apparatus of claim 1 further comprising a container for collecting debris, the screen being disposed between the brush and the container.

6. The apparatus of claim 1 further comprising a doctor blade in contact with the roller and positioned so as to remove debris remaining on the roller following its contact with the brush.

7. The apparatus of claim 1 wherein the cylinder rotates in a direction and further comprising means for rotating the roller in said direction.

8. The apparatus of claim 1 wherein the cylinder has an imaging region, the roller extending axially at least across the imaging region.

9. The apparatus of claim 8 wherein the roller, the brush and the screen each have respective longitudinal extents, the longitudinal extents of the brush and the screen being at least equal to the longitudinal extent of the roller.

10. The apparatus of claim 1 further comprising means for establishing a contact pressure between the roller and the printing member.

11. Cleaning apparatus for cleaning a printing member associated with a rotary cylinder, the apparatus comprising:

a. cleaning means for removing debris from the printing member;

b. a tilt-out panel to which the cleaning means is affixed, the panel being movable from a closed position with the cleaning means proximate to the rotary cylinder to an open position with the cleaning means away from the rotary cylinder;

c. means, operative with the panel in the closed position, for retractably bringing the cleaning means into contact with the printing member, wherein the cleaning means comprises:

d. a roller for making rotating contact with the printing member, the roller having an elastomeric surface;

e. a fixed screen; and f. a brush in rotating contact with the roller and with the screen, the brush removing debris from the roller and shedding it through the screen.

12. The apparatus of claim 11 wherein the elastomeric surface is an open-celled foam.

13. The apparatus of claim 11 wherein the foam is a polyurethane.

14. The apparatus of claim 11 further comprising a container for collecting debris, the screen being disposed between the brush and the container.

15. The apparatus of claim 11 further comprising a doctor blade in contact with the roller and positioned so as to remove debris remaining on the roller following its contact with the brush.

* * * * *